United States Patent [19]

Whittenberger

[11] 4,167,265

[45] Sep. 11, 1979

[54] FOLDING MACHINE AND CONTROL

[75] Inventor: John S. Whittenberger, Sidney, Ohio

[73] Assignee: Graphics Equipment International Corporation, Chicago, Ill.

[21] Appl. No.: 893,842

[22] Filed: Apr. 6, 1978

Related U.S. Application Data

[63] Continuation of Ser. No. 734,564, Oct. 21, 1976, abandoned.

[51] Int. Cl.[2] ..... B65H 45/14

[52] U.S. Cl. ..... 270/68 A; 270/5; 270/61 R

[58] Field of Search ..... 270/4–9, 270/20, 61 R, 62, 68 A; 318/345 R, 345 C, 345 CA, 345 CB, 345 G

[56] References Cited

U.S. PATENT DOCUMENTS

| | | | |
|---|---|---|---|
| 2,294,620 | 9/1942 | Kiessling | 270/20 |
| 3,305,716 | 2/1967 | Wigington | 318/345 G |

OTHER PUBLICATIONS

Advertising Circular for Baumfolder Division of Bell & Howell Co.; 3-23-64.

*Primary Examiner*—Edgar S. Burr
*Assistant Examiner*—A. Heinz
*Attorney, Agent, or Firm*—Griffin, Branigan & Butler

[57] ABSTRACT

Each section of a buckle sheet feed folding machine is driven by a silicon controlled rectifier (SCR) controlled DC motor. The speed of the first section is infinitely variable by means of a rheostat in the SCR control. A signal related to the speed of the first section is applied to all subsequent SCR controls such that the speed of all fold sections will follow changes made to the speed of the first section. Each section also includes a rheostat to vary the relative speed between that section and the first. A switch is provided at each subsequent section in order to disconnect the first section speed signal and apply an independent control signal.

5 Claims, 5 Drawing Figures

FOLDING MACHINE AND CONTROL

This is a continuation, of application Ser. No. 734,564, filed Oct. 21, 1976 now abandoned.

BACKGROUND OF THE INVENTION

This invention relates broadly to buckle-type sheet folding machines and more particularly to an infinitely variable power drive therefor.

A buckle-type folding machine normally comprises a series of rollers and fold-pan assemblies. A sheet of paper to be folded is inserted between two rotating rollers of a first roller set and is driven by these two rollers into a fold pan of a fold-pan assembly. A forward edge of the sheet eventually strikes a paper stop in the fold-pan; however, the two rollers continue to feed the sheet forward. Thus, the sheet buckles and the bulge of this buckle eventually extends between two rollers of a second roller set. These rollers fold the sheet at the bulge and feed this folded edge into a second fold pan of a second fold pan assembly. Upon striking a second paper stop there is a new buckle in the sheet and this buckle is, in turn, inserted between two rollers of a third roller set. This process continues until the sheet is folded a desired number of times.

After passing through a first buckle fold section, a sheet having parallel folds may then be conveyed to a second fold section at a right angle to the first in order to make folds perpendicular to the first folds. The sheets may then be fed to a third fold section and so on, each section being positioned at a right angle to the next preceding section. Alternatively, two or more sections may be arranged in tandem rather than at right angles.

The speed of each section of a multisection fold machine will vary according to the sheet length and the position and number of folds made in that section. To provide for this variable speed, two approaches have been used in prior buckle folders having independent sections. According to one approach, each section has its own independent drive motor. These machines have the disadvantage that each independent section of the folder must be adjusted for speed independently. Thus, when the overall speed of the system is changed, an operator must move to each section and reset that section's speed.

It is an object of this invention therefore to provide a variable speed drive to a multisection buckle fold feeder whereby the speed of the entire system may be varied after set-up by a single adjustment.

According to another prior-art approach, a drive motor is provided at the first fold section and a drive connection is made to each section through some mechanical variable speed device such as a varisheave. Mechanical variable speed devices, however, suffer from the disadvantage of being limited to speed variations of about four to one. Thus, where the folder is set up at a minimum speed of 1500 inches per minute, the maximum production speed of the machine would only be 6000 inches per minute; and, moreover, such devices also suffer from high power loss.

It is another object of this invention, therefore, to provide a variable speed drive to a buckle folder having a greater speed range, both overall and between sections, than has been possible with prior machines.

SUMMARY

Each section of a multisection buckle fold machine is driven by an SCR controlled DC motor. The speed of each motor may be adjusted with respect to the speed of a primary motor and speed variations are thereafter dependent upon speed variations in the primary motor.

BRIEF DESCRIPTION OF THE DRAWINGS

The foregoing and other objects, features, and advantages of the invention will be apparent from the following more particular description of a preferred embodiment of the invention as illustrated in the accompanying drawings in which like reference characters refer to the same parts throughout the different views. The drawings are not necessarily to scale, emphasis instead being placed upon illustrating the principles of the invention.

DESCRIPTION OF THE PREFERRED EMBODIMENTS

Figure 1:
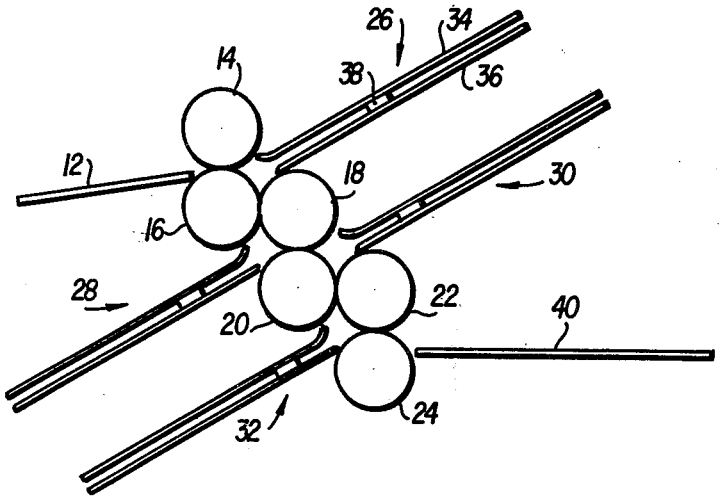
FIG. 1 is a schematic side view of a single section of a buckle type sheet folding machine.

Referring to FIG. 1, a buckle-type folding machine section comprises an input conveyor 12, rollers 14, 16, 18, 20, 22, and 24, and fold pans 26, 28, 30 and 32. Each fold pan, as for example 26, comprises an upper plate 34 and lower plate 36 and a stop member 38 therebetween. A conveyor 40 is provided at the output of the folder to move the folded sheets in a direction approximately parallel to, but offset from the direction of conveyor 12.

As is well understood in the art, a sheet is drawn between rollers 14 and 16 and enters fold pan 26. The sheet stops at stop member 38 and is caused to buckle by the continued drive from rollers 14 and 16. The buckled portion of the sheet is caught between rollers 16 and 18 thereby forming a fold. The sheet having a single fold is then fed into fold pan 28. The sheet is similarly folded at each pan to provide a number of parallel folds. The number of pans may be increased or decreased as desired.

Figure 2:
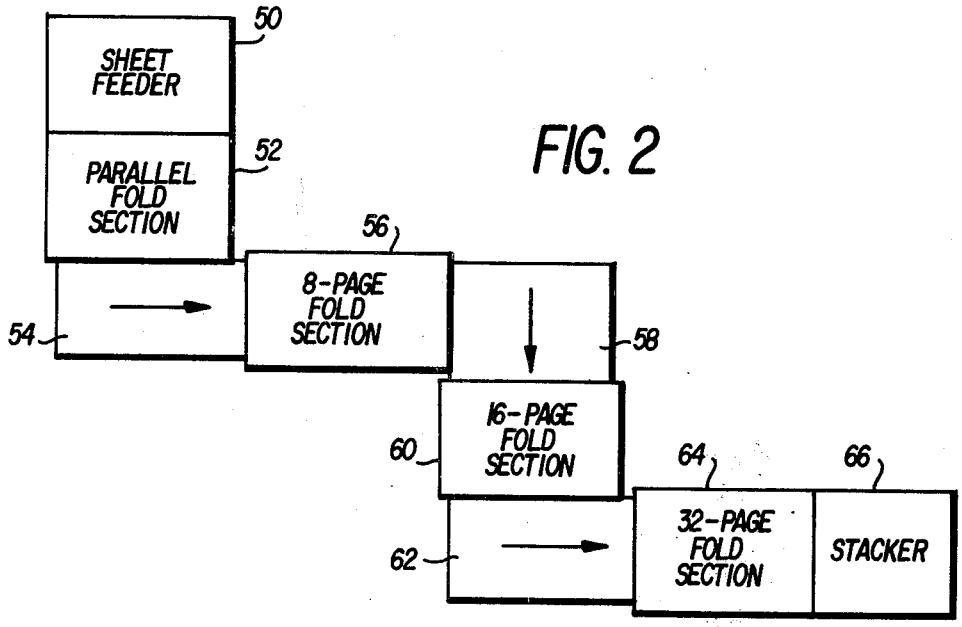
FIG. 2 is a block diagram of a multisection buckle type folding machine.

FIG. 2 shows a multisection fold machine in which a sheet is fed through several folders like that shown in FIG. 1, each being positioned at a right angle to the preceding fold section. Sheets are sequentially fed from a stack in sheet feeder 50 into a first buckle fold parallel section 52. After a number of parallel folds are made in a sheet in fold section 52, the sheet is ejected to a conveyor 54 which carries the folded sheet in the direction indicated by an arrow to a second buckle fold section. This section is referred to by those in the art as an 8-page fold section because a sheet folded once in each of the first two fold sections can be trimmed to provide an 8-page leaflet. From the 8-page fold section 56 the sheet is carried by a conveyor 58 to a 16 page fold section 60. Finally, the sheet is carried by conveyor 62 to a 32-page fold section from which the folded sheet is fed into a stacker 66. It will be understood by one skilled in the art that each fold section may include several fold pans and various members of bucklefold sections may be included in the overall system.

Figure 3:
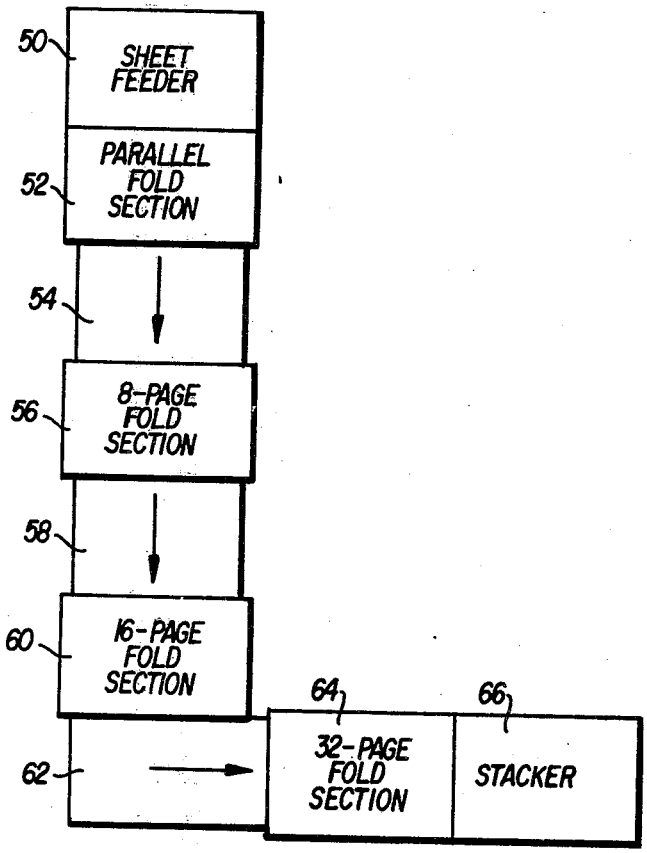
FIG. 3 is a block diagram of an alternative arrangement of a multi-section buckle-type folding machine.

FIG. 3 shows a tandem configuration of the 8, 16 and 32 Page folding sections. In this configuration, the folds performed in the 8 Page section 56 are parallel to those performed in the Parallel fold section 52. Similarly, for the folds performed in 16-page fold section 60. Folding in the 32 Page fold section 64 is performed at a right angle to that of the 16 Page fold section 60. Due to the modular construction of the folder, any section (8, 16 or 32 Page) may be operated at right angle or tandem. Further, not all folding sections may be required to fold a certain signature; and, the signature imposition (sequence of folding) dictates the machine configuration.

Figure 4:
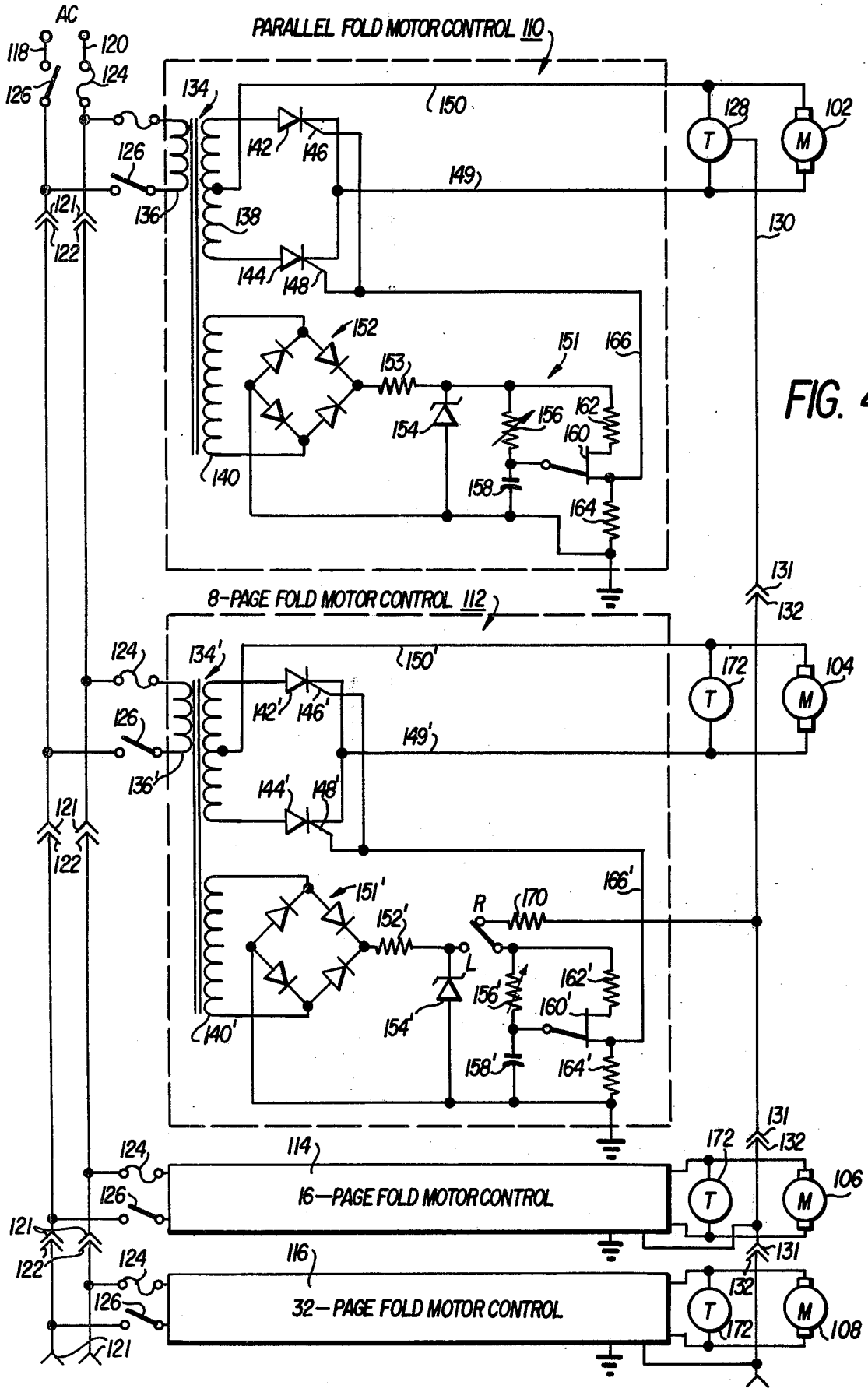
FIG. 4 is a partial schematic, partial block diagram of a multisection folding machine variable speed control employing principles of this invention.

Referring to FIG. 4, each fold section is driven by a DC motor 102, 104, 106, or 108. These motors may be of any type DC machine including shunt field, series field (universal motors), or permanent magnet type machines. Motor 102 is controlled by an SCR circuit 110. Similarly, motors 104, 106, and 108 are controlled by SCR control circuits 112, 114, and 116, respectively. Power to the control circuits and thus the DC motors is supplied from an AC source through lines 118 and 120. Modular construction is a feature of the present machine; thus, each section is provided with a receptable 121 and plug 122. Circuit breakers 124 and on-off switches 126 are provided at each fold section.

A tachometer 128 is provided to give an indication of the speed of motor 102. The tachometer shown is responsive to the DC voltage applied to the DC motor; however, the tachometer might also be of the type which is connected to the motor shaft. The latter would be used in systems requiring more accurate speed control. The tachometer 128 gives an output 130 indicative of the motor speed. The output 130 should be a square wave synchronized with an AC supply. The signal is applied through receptacles 131 and plugs 132 to each subsequent fold motor control for purposes to be discussed.

The motor control circuit 110 may be of any known type, as for example those described in the second edition of the GE Silicon Controlled Rectifier Manual, Second Edition, pages 120 through 127.

In the circuit shown, AC current is applied through transformer 134, having primary 136 and secondaries 138 and 140. Current flowing through secondary 138 is rectified by SCRs 142 and 144. The firing angle of these SCRs is determined by signals applied to their respective gates 146 and 148. The average DC current applied to DC motor 102 through lines 149 and 150 is determined by the firing angle of SCRs 142 and 144 set by firing circuit 151.

Current is secondary 140 is passed through diode bridge 152 and resistor 153 to voltage regulating zener diode 154. The voltage across this diode is applied across a rheostat 156 and series capacitor 158 which form an RC firing circuit for unijunction transistor 160 in series with resistors 162 and 164. Unijunction 160 operates as a relaxation oscillator in a well-known manner, periodically applying a pulse of current through line 166 to gates 146 and 148. The firing angle of the SCRs is determined by the RC time constant of rheostat 156 and capacitor 158. Thus, the speed of motor 102 is varied by adjusting the rheostat 156.

The 8-page fold motor control 112 operates in the same manner as the parallel fold motor control and additionally includes a switch 168 and resistor 170. In the position shown, the voltage across the unijunction relaxation oscillator is determined by the parallel fold speed signal on line 130. The SCR firing angle and thus the average DC signal applied to motor 104 varies with changes in the speed signal on line 130. The relative speed of motor 104 with respect to motor 102 may be varied by adjusting rheostat 156'. If switch 168 is moved from the remote R to the L, or local, position the 8-page motor control is completely independent of the parallel motor control.

The 16-page and 32-page fold motor control circuits are identical to the 8-page fold motor control; and additional tachometers 172 may be provided at each DC motor.

It should be understood that as an alternative to positioning each control circuit at each buckle fold section, all motor controls may be positioned at a central control box. In that case, lines 149' and 150' lead from the central control box to the respective DC motors.

Figure 5:
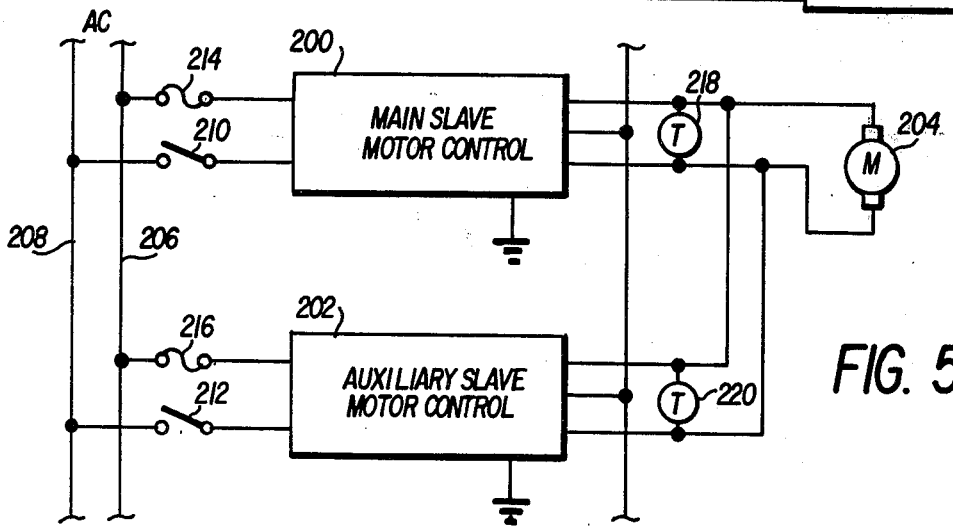
FIG. 5 is a partial schematic, partial block diagram of an alternative variable speed motor control employing the principles of this invention.

FIG. 5 shows yet another alternative in which each DC motor 204 is controlled by either of two control circuits 200 and 202, located respectively at the central control and the particular fold section. Power is applied from AC power lines 206 and 208 through the control circuit determined by switches 210 and 212. Circuit breakers 214 and 216 and tachometers 218 and 220 may also be provided.

From the above description, it can be understood than an operator first sets the parallel fold motor control, or master control, at a low set-up speed by adjusting rheostat 156. Each selection switch at all other, or slave, control circuits are then set to the remote position and each rheostat 156' is then adjusted to provide the desired motor speed relative to the speed of DC motor 102. Once all fold sections are set at the set-up speed, rheostat 156 is adjusted to change the speed of all DC motors without further adjustment of individual rheostats. Because of the range of SCR motor control circuits, the production speed may later be set many times higher than the set-up speed.

While the invention has been particularly shown and described with reference to preferred embodiments thereof, if will be understood by those skilled in the art that various changes in form and detail may be made therein without departing from the spirit and scope of the invention as defined by the appended claims. For example, many SCR controlled circuits for DC motors are available; and, other folding configurations can also be used.

I claim:

1. A sheet folding machine comprising a plurality of fold sections, and further comprising:

an electric power supply;

a separate DC motor associated with each of said fold sections;

a master SCR control circuit between said power supply and one of said DC motors, said master SCR control including a master rheostat for varying the average DC power applied to said one of said DC motors;

at least one slave SCR control circuit between said power supply and at least a second of said DC motors, said slave SCR control circuit including at least one SCR-type element for controlling the DC power applied to said second of said DC motors, said SCR control circuit further including a relaxation oscillator having a timing circuit comprising a slave rheostat and a capacitor for determining a pulse period of said relaxation oscillator, said relaxation oscillator providing output pulses to said at least one SCR-type element for controlling the firing angle of said at least one SCR-type element to thereby control the average DC power applied to said second of said DC motors;

connection means connecting said slave SCR control circuit to said master SCR control circuit, said connection means providing a voltage indication signal to said timing circuit of said slave SCR control circuit indicative of the power applied to said one of said DC motors to thereby control the spacing of pulses emanating from said relaxation oscillator to affect the firing angle of said at least one SCR-type element and thereby vary the average DC power applied to said second of said DC motors.

2. The sheet folding machine of claim 1 further comprising a two-position selection switch, said slave SCR control circuit being connected to said connection means when said switch is in a first position and said slave SCR control circuit being connected directly to said power supply independent of said master SCR control circuit when said switch is in a second position.

3. The sheet folding machine of claim 1 wherein said connection means comprises a tachometer having an output indicative of the speed of said one of said DC motors.

4. The sheet folding machine of claim 3, further comprising a two-position selection switch, said slave SCR control circuit being connected to said connection means when said switch is in a first position and said slave SCR control circuit being connected directly to said power supply independent of said master SCR control circuit when said switch is in a second position.

5. The sheet folding machine of claim 1, further comprising a redundant slave SCR control circuit remote from said one slave SCR control circuit, and switch means for connecting one or the other of said slave SCR control circuits between said power supply and said second of said DC motors.

* * * * *